US007475522B2

(12) United States Patent
Ponti

(10) Patent No.: US 7,475,522 B2
(45) Date of Patent: Jan. 13, 2009

(54) ENVELOPE FILLING MACHINE

(75) Inventor: Francesco Ponti, Cerbara-Citta'di Castello (IT)

(73) Assignee: C.M.C. S.r.l., Cerbara-Citta di Castello (Perugia) (IT)

( * ) Notice: Subject to any disclaimer, the term of this patent is extended or adjusted under 35 U.S.C. 154(b) by 0 days.

(21) Appl. No.: 11/759,042

(22) Filed: Jun. 6, 2007

(65) Prior Publication Data

US 2008/0302068 A1 Dec. 11, 2008

(51) Int. Cl.
*B65B 43/26* (2006.01)

(52) U.S. Cl. ..... 53/381.5; 53/206; 53/266.1; 53/284.3; 53/569

(58) Field of Classification Search ..... 53/381.3, 53/381.5, 381.7, 117, 206, 266.1, 460, 569, 53/284.3; 270/58.06
See application file for complete search history.

(56) References Cited

U.S. PATENT DOCUMENTS

| | | | | | |
|---|---|---|---|---|---|
| 2,835,090 | A | * | 5/1958 | De Maine | 53/569 |
| 3,280,679 | A | * | 10/1966 | Huffman | 83/79 |
| 4,547,114 | A | * | 10/1985 | Watrous et al. | 414/793.9 |
| 5,127,640 | A | * | 7/1992 | Orsinger et al. | 270/52.04 |
| 5,409,206 | A | * | 4/1995 | Marzullo et al. | 270/179 |
| 5,429,349 | A | * | 7/1995 | Supron et al. | 271/179 |
| 5,581,972 | A | * | 12/1996 | Antonelli | 53/75 |
| 5,950,399 | A | * | 9/1999 | Viens et al. | 53/381.6 |
| 6,813,870 | B2 | * | 11/2004 | Iwamoto | 53/460 |
| 6,996,959 | B2 | * | 2/2006 | Sting | 53/569 |
| 2003/0150194 | A1 | * | 8/2003 | Ponti | 53/569 |

FOREIGN PATENT DOCUMENTS

| | | | |
|---|---|---|---|
| EP | 1226980 | * | 7/2002 |
| EP | 1226980 | A | 7/2002 |
| EP | 1275523 | A | 1/2003 |
| EP | 1473173 | * | 11/2004 |
| EP | 1473173 | A | 11/2004 |
| WO | WO2006013465 | A | 2/2006 |

OTHER PUBLICATIONS

European Search Report.

* cited by examiner

*Primary Examiner*—Thanh K Truong
(74) *Attorney, Agent, or Firm*—William J. Sapone; Coleman Sudol Sapone P.C.

(57) ABSTRACT

An envelope filling machine for introducing sheets into envelopes includes a sliding surface, for transferring the sheets to an envelope filling station by means of pushing lugs, operated along the sliding surface. An envelope supplying conveyor supplies individual envelopes to the station placing them between vertical shafts of a pair of screws. The turns of the screws hold the sides of the envelopes and move each envelope downwards keeping the envelope separated from a subsequent envelope. When the envelope has come to rest on a conveyor belt placed between and under the screws, the lugs push the sheets into the envelope kept steady by movable stop strips yieldingly maintained by elastic means. When the sheets are fully inserted, the lugs push the envelope and force the movable strips to swing and let the filled envelope leave the envelope filling station.

13 Claims, 7 Drawing Sheets

ENVELOPE FILLING MACHINE

BACKGROUND OF THE INVENTION

The present invention relates to an envelope filling machine, aimed in particular at introducing sheets into envelopes.

DESCRIPTION OF THE PRIOR ART

The development of the so-called "mailing" field, that includes sending sheet printed materials, such as letters, advertisement prints, brochures, magazines, and the like (in the following referred to as sheets) to a large number of different addressees, often entrusted to utility firms, creates the need of envelope filling machines, which can stuff envelopes at very high speeds.

Some envelope filling machines form the envelopes from a paper sheet folded around the material to be mailed. Other envelope filling machines introduce the sheets into already formed envelopes. The empty envelopes are stacked within a storage area, such as a vertical magazine, from which they are taken and supplied one by one to an envelope filling station.

The envelope magazine and the means used to supply the envelopes to the filling station form a unit better known as envelope feeder.

Other means, commonly designated as sheet feeders, place the materials (sheets, prints, brochures, magazines and so on) to fill the envelopes, onto a sliding surface below. Transferring means act along the sliding surface and, in step relation with the envelope feeding, transfer the sheets to the envelope filling station.

The envelope filling machine of the present invention belongs to this last mentioned type of machine, i.e. it inserts materials (sheets, prints, brochures, magazines and so on) into already formed envelopes.

The envelope feeder delivers the envelopes to the filling station where suitable means open the apertures of the envelopes, e.g. with jets of air.

According to a known solution, the envelopes feeder is situated above the sliding surface, just upstream of the envelope filling station.

The position of the envelope feeder above the sheet sliding surface is advantageous, because it does not cause any change in the direction of the path run by the envelopes to the filling station and beyond it.

The envelopes are transferred in sequence to the envelope filling station, in suitable time relation with the feeding of the sheets along the sliding surface. In particular, each individual envelope is transferred to the envelope filling station after the envelope filled before has been moved away.

Obviously, this causes reduction of the machine operation speed and consequently, the production rate is lower than the one which the current high speed sheet and envelope feeding devices would allow.

According to a solution disclosed in the patent publication EP 1473173 an envelope filling machine includes a sheet conveying line and a sheet transferring line, situated downstream of the conveying line and leading to an envelope filling station.

The envelopes are transferred to the envelope filling station along a direction transversal to the transferring line the sheets.

The envelope filling station includes a pair of side-by-side vertical extending screws supported rotating on a vertical axis.

The screws are operated to rotate in opposite directions at a speed, suitably controlled according to envelope and sheet transferring steps.

The envelopes are placed in the filling station with the bottom edge inserted into the space between the two lowermost turns of each screw and the facing with the closing tab down. The side of the envelope opposite to the arriving direction rests against a side wall.

When the screws rotate, the envelope is moved upwards and a second envelope can be placed therebelow, in the space between the two lowermost threads just become free.

When the envelope reaches the space between the two uppermost turns, the sheets are pushed by the transferring line to insert into the envelope, whose aperture edges are kept wide apart by an air jet. Meanwhile, the shafts of the screws act as a stop for the envelope.

Further rotation of the screws move the filled envelope clear of the shafts, so that it can go ahead, further moved by the transferring line, to closing, stacking and so on.

There is the need of a very accurate time relation between the raise of the envelope above the screw shafts and the arrival of the leading edges of the sheets at the bottom of the envelope. In case the leading edges of the sheets contact the bottom of the envelope before the envelope is moved clear of the screw shafts, envelope and sheets can get folded and compressed, possibly causing jams.

Conversely, in the leading edges of the sheets contact the bottom of the envelope too late, after that the envelope is moved clear of the screw shafts, insertion of the sheets can be uncompleted.

Such accurate time relation limit the operation speed of the machine.

Because the closing flap of the envelope is connected to the lower facing, the sheets must handled by the transferring line, which act on them from above. However, the sheets are released by sheet feeders which place them on the sliding surface.

Therefore, before reaching the filling station, the driving action on the sheets is transferred from the sliding surface, where lugs move the sheets, to a transferring conveyor acting on the sheets from above.

This transfer requires accurate time relation between operation of the lugs of the sliding surface and the transferring conveyor. Also this accurate time relation need limit the operation speed of the machine.

This machine disclosed by publication EP 1473173 is effective in its operation. Raising of the envelope allows to place a new empty envelope without waiting for the one being filled to leave the filling station.

Moreover, the screw design allows a reliable handling of the envelopes, which are uniquely held between the pairs of turns.

However, further improvements in the operation speed are sought by means of the present invention.

SUMMARY OF THE INVENTION

Accordingly, the object of the present invention is to propose an envelope filling machine which introduces sheets into envelopes with a higher operation speed.

Another object of the present invention is to propose an envelope filling machine, which has a simple and functional structure, and which is highly reliable and versatile in its use.

Another object of the invention is to propose an envelope filling machine in which swelling of the envelope, due to opening by the air jet, does not shrink the envelope in width as much as to hinder insertion of the sheets.

The above mentioned objects are obtained in accordance with the content of the claims.

BRIEF DESCRIPTION OF THE DRAWINGS

The characteristic features of the invention will be pointed out in the following description, with reference to the enclosed drawings, in which.

DISCLOSURE OF THE PREFERRED EMBODIMENT

Figure 1:
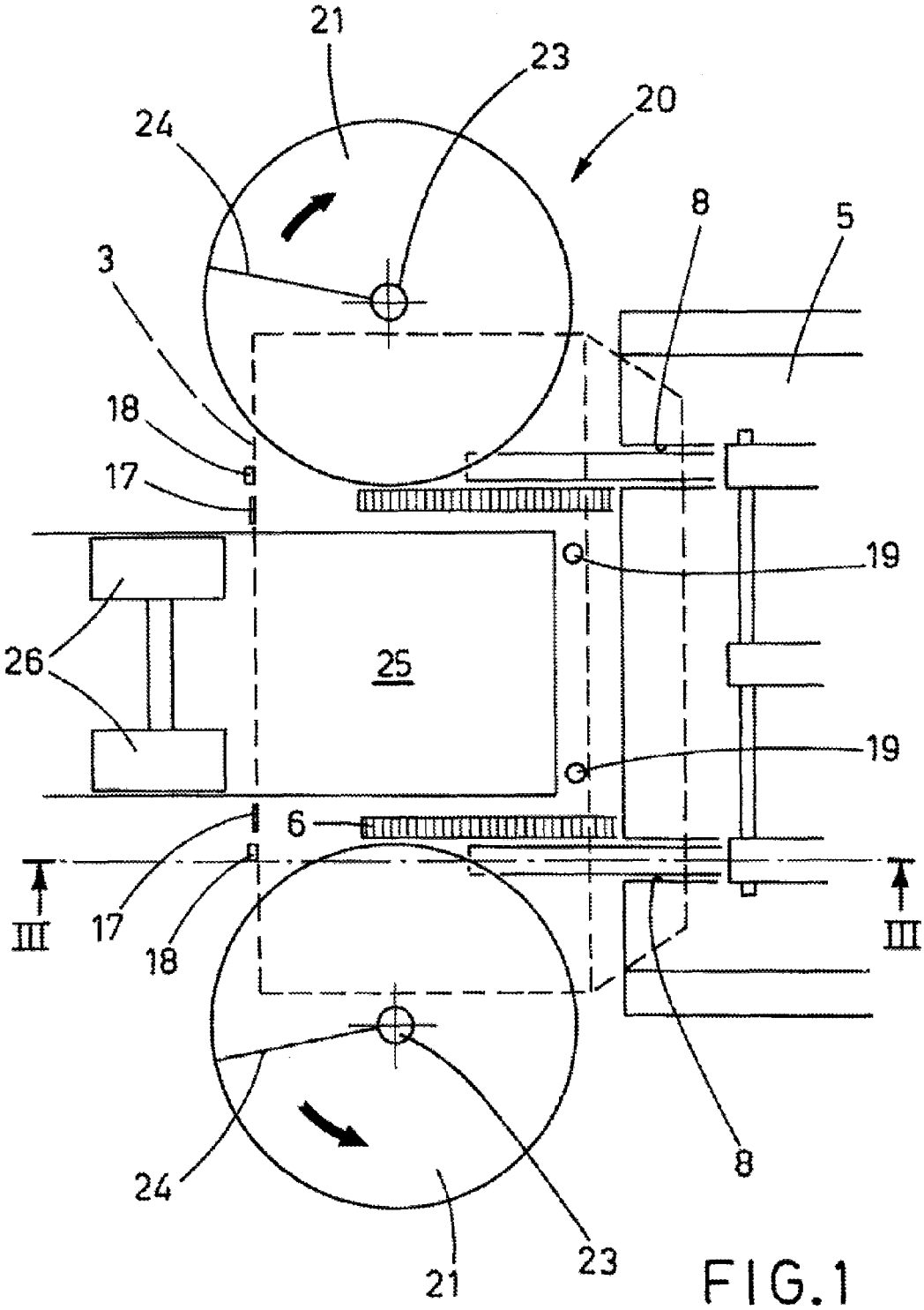
FIG. 1 is a top view of the proposed envelope filling machine.

With reference to the above figures, reference numeral 1 indicates the envelope filling station of the proposed envelope filling machine, which introduces sheets 2 into envelopes 3.

The sheets 2 are moved along a sliding surface 5. With the word "sheets" not only sheets are in fact meant, but also other items to introduce in the envelopes, such as magazines, booklets, pamphlets, letters, advertisement prints and like items.

Pushing means 7, e.g. pairs of lugs or prongs, move along the sliding surface 5 in the direction indicated with the arrow A, as they are moved by a driving line 6, situated therebelow, including e.g. endless chains.

The lugs of the pushing means 7 protrude from longitudinal slots 8 made along the sliding surface 5, and rest with the bottom on suitable support means 9, aimed at keeping the pushing means 7 in a raised position.

The envelope filling station 1 is located just downstream of the sliding surface 5. The bottom of the filling station is defined by a conveyor belt 25 that is placed after the sliding surface 5 at a slightly lower level (see FIGS. 3 to 7). The conveyor belt 25, which is narrower than the sliding surface 5, is operated in the same direction A and extends beyond the filling station 1, opposite to the sliding surface 5.

A pressure roller or a pair of pressure rollers 26, as shown in FIG. 1, are located downstream of the station 1, in contact with the upper run of the conveyor belt 25.

Between the sliding surface 5 and the conveyor belt 25, there are situated a pair of nozzles 19, which result to be in the envelope filling station 1, The task of the nozzles 19 is that of sending jets of air toward the aperture of the envelopes 3 to make them open.

The envelope filling station 1 includes an envelope handling group 20 comprising two envelope handling means 21. The handling means 21 are formed by vertically extending screws 21.

The screws 21 are situated at both sides of the path followed by the sheets 2, so that their shafts 23 are set at a distance from one another corresponding to the width of the envelopes. The shafts are rotated by motor means, not shown in the figures, in opposite directions so that the spaces 22 between the turns, or threads, of the screws 21 "moves" downwards.

The motor means are operated continuously.

The envelopes 3 are supplied to the envelope filling station 10, in the direction indicated with the arrow B (see FIG. 3), extending longitudinally and concurrent with direction A of the conveying line along which the sheets 2 move.

The envelope feeder, which is not shown in its entirety in the FIGS. 3 to 7, is located above the sliding surface 5. Only the terminal section of the envelope supplying conveyor 16 is illustrated, from which each envelope 3 exits.

The envelope feeder, as well known in this field, removes single envelopes 3 from the bottom of a stack and feeds them to the supplying conveyor 16 with horizontal arrangement. The upper facing is the one provided with the closing flap 13.

The envelope 3 exits from the conveyor 16 and is introduced between the shafts 23, above the turns of the screws 21. As mentioned before, the shafts 23 are set at a reciprocal distance corresponding to the width of the envelope. The width of the envelope is considered to be the distance between the sides of the envelope parallel to the envelope supplying direction B, in this case the shorter edges of the envelope.

Figure 3:
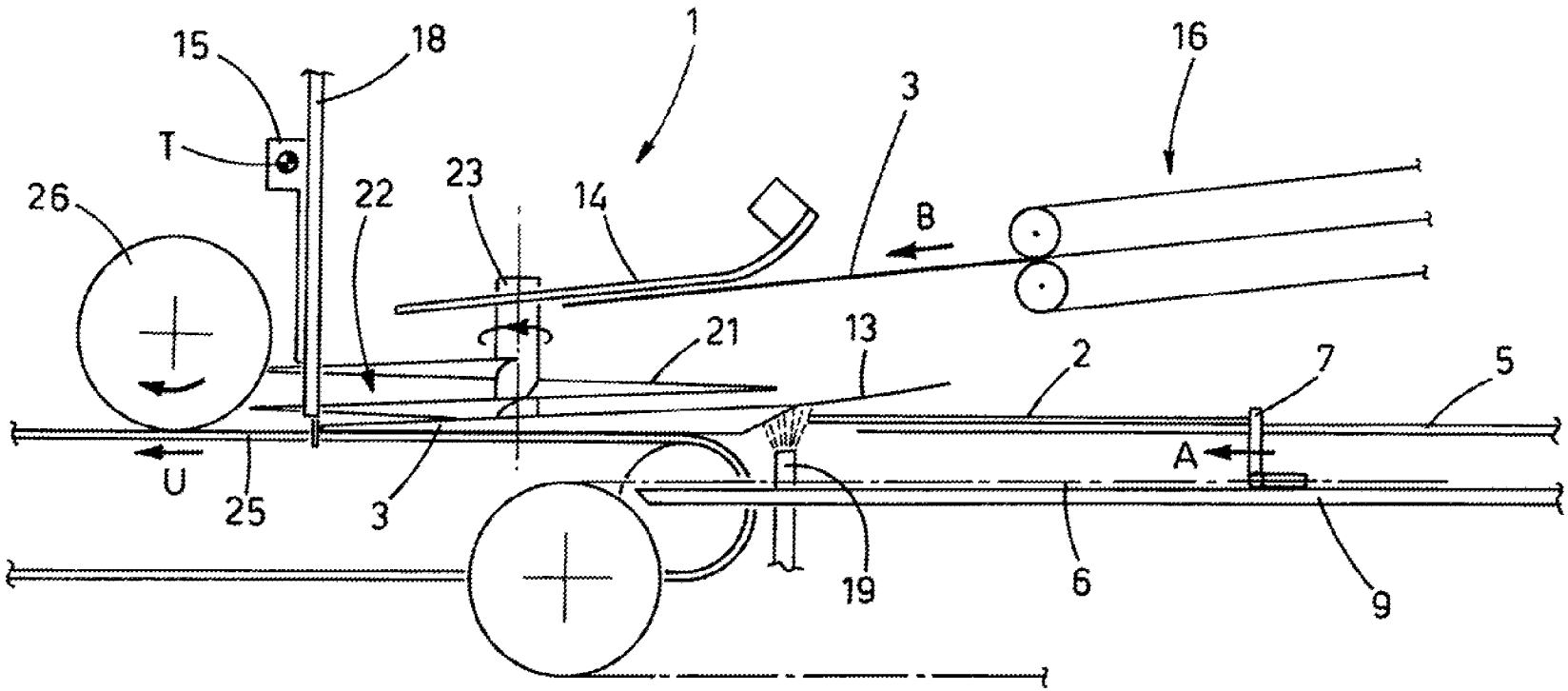
FIGS. 3 to 7 show lateral views of the filling station, as seen along section line III-III of FIG. 1, in a sequence of operation steps.

To better guide the envelope toward the station 1, guiding means 14, formed e.g. by a sloping plate, are disposed above the screws 21 (see FIG. 3). The front edge of the sloping plate 14 is bent upwards for facilitating guidance of the envelopes.

The leading edge 4 of the envelope, i.e. the closed edge or bottom edge of the envelope, goes in abutment against stationary stop means, constituted by stationary vertical stems 18 situated just after the shafts 23 of the screws 21, considering the forward direction A and between the screws 21. The stationary vertical stems extend downwards up to a distance from the conveyor belt 25 equal or shorter than the space between two consecutive turns of the screws 21, i.e. sufficient to let an envelope pass thereunder (See FIG. 3).

Two vertical stems give the best stability to the envelopes set against them, but it would be also possible providing only one vertical stems, for instance set in a position corresponding to a central line passing through the filling station 1.

Beside the stationary vertical stems 18, there are two movable stop means, constituted by vertical strips 17 supported by oscillating elements 15, swinging about a horizontal axis T extending crosswise to the advancement direction A. The horizontal axis T is situated just after the two stationary vertical stems 18.

Accordingly, also the vertical strips 17 can oscillate, swinging parallel to the forward direction A. The oscillating vertical strips 17 extends downwards to a level lower than the upper run of the conveyor belt 25. To allow such configuration, the strips 17 are situated bilaterally with respect to the conveyor belt 25, i.e. one at a respective side thereof.

Elastic means, not shown in the figures, are provided for keeping the hanging swinging elements 15 down.

Operation of the envelope filling machine is as follows.

The sheets 2, are fed along the sliding surface 5, being moved forward by the pushing means 7 of the driving line 6. The sheets 2 are fed to the filling station at regular intervals of time.

Meanwhile, the envelopes 3 are supplied by the feeding device via the envelope supplying conveyor 16 to the filling station 1. Each time, one envelope is positioned between the shafts 23 of the screws 21, resting above the turns thereof, and in abutments against the stationary vertical stems 18 (FIG. 3).

Figure 4:
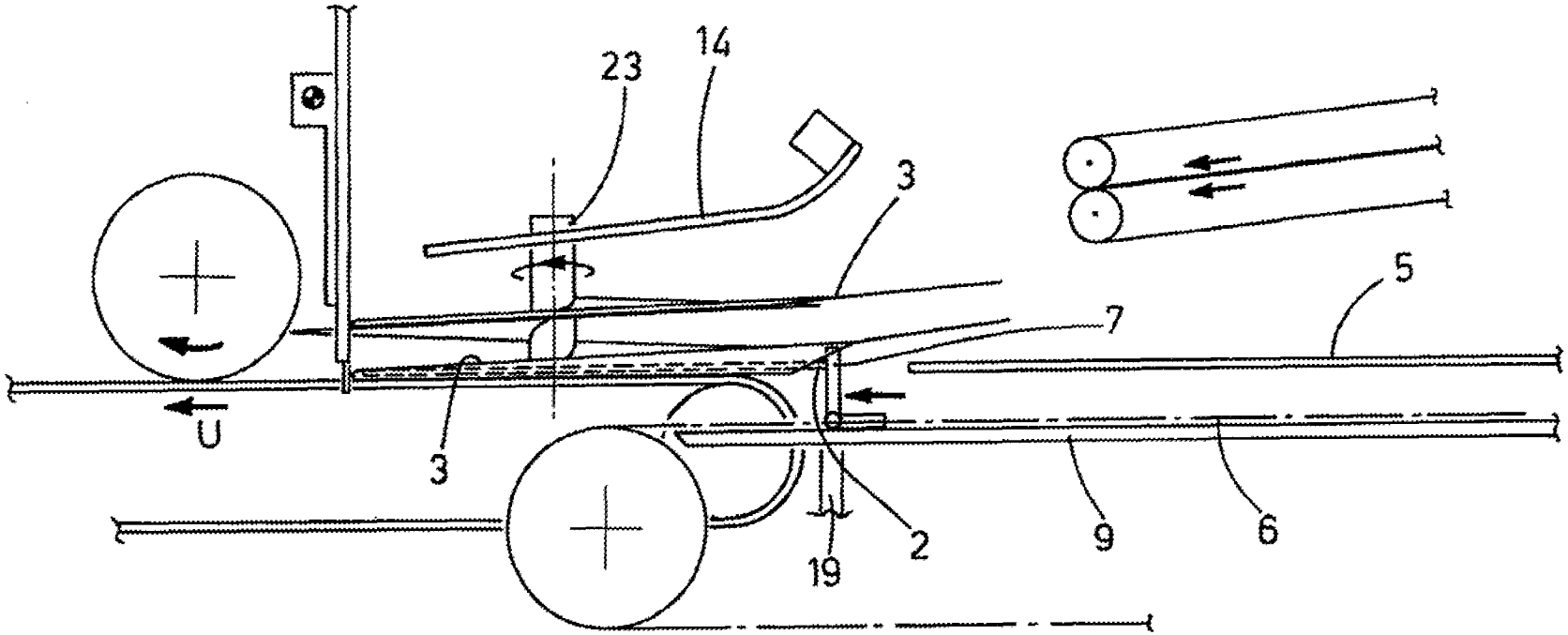
Figure 5:
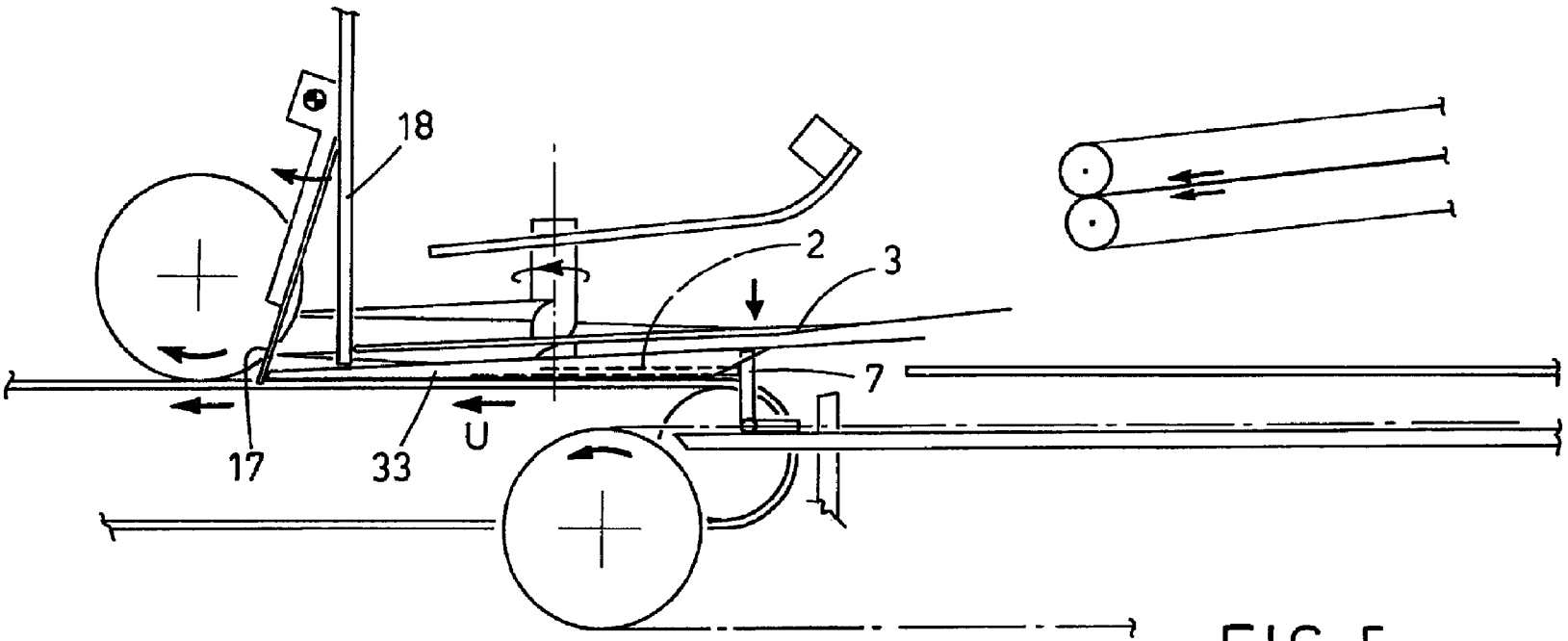
Figure 6:
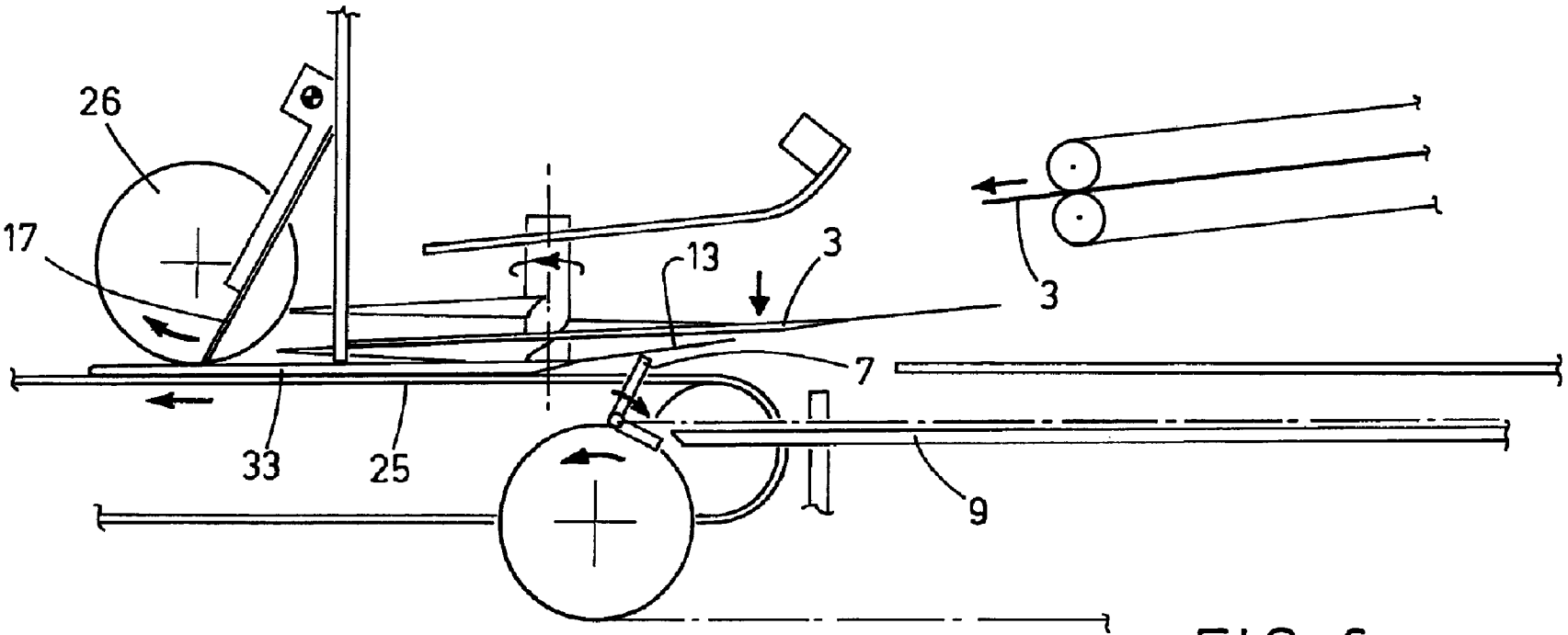

Continuous operation of the shafts 23 make the initial edges 24 of the screws 21 go above the envelope 3 and then makes the envelope 3 be taken into the spaces 22 between the turns of the rotating screws 21 and moved downwards (FIGS. 4 to 6). The opposite rotation directions of the screws concur to keep the envelope pushed against the stationary vertical stems 18 and then against the movable vertical strips 17.

More than one envelope can be lodged between the turns of the screws, as it can be seen in FIG. 4, which shows a moment just after the situation of FIG. 3. This means that most of the time at least two envelopes 3 are present in the filling station 1, separated by the turns of the screws 21.

Figure 7:
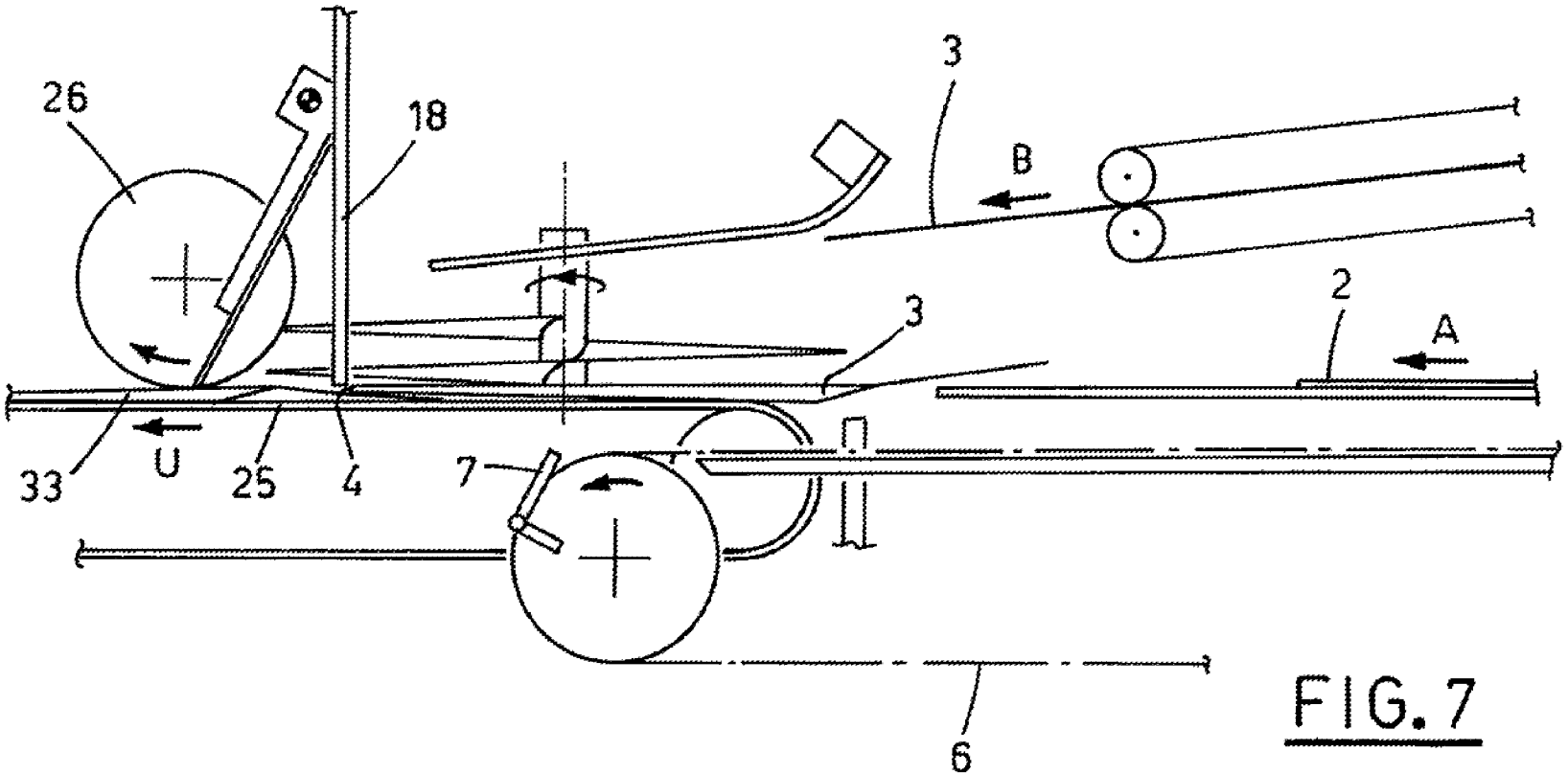

When the envelope 3 reaches the conveyor belt 25 below, further rotation of the screws 21 has no effect on it, since the turns of the screws slides over the facing of the envelope itself which is kept between the shafts 23 and pushed by the action of the conveyor belt 25 against the lower ends of the vertical strips 17. FIG. 7 shows the situation just a moment before the envelope is completely laying on the conveyor belt 25. It can be seen that the turns of the screws keep the leading edge 4 of the envelope still raised and against the stationary stems 18.

This is the moment when the nozzles 19 are activated (again FIG. 3) to open the envelope just before the sheets 2 arrive pushed by the lugs 7. The turns of the screws 21 keep opening of the envelope limited, so as to also limit swelling of the envelope, which would hinder insertion of the sheets.

Meanwhile, another envelope 3 is supplied to the station 1.

Then the lugs 7 push the sheets 2 into the open envelope 3 (See again FIG. 4); the elastic force of the elastic means is strong enough to keep the envelope steady during insertion of the sheets.

When the sheets 2 go to contact the bottom of the envelope, the lugs 7 continue on their way along direction A, thus pushing forward also the filled envelope 33 (See FIG. 5). This action forces now the vertical strips 17 to swing against the action of the elastic means, allowing the filled envelope 33 to pass under the stationary vertical stems 18.

When the filled envelope 33 reaches the pressure rollers 26, the lugs 7 leave the support means 9 and fall, due to gravity, tilting and bending rearward, not to push the trailing edge of the folding flap 13 downwards while turning down at the end of their forward stroke (FIG. 6). The motion of the filled envelope 33 continues in exiting direction U under the action of the pressure rollers 26 and the conveyor belt 25.

This way, the filled envelope 33 leaves the envelope filling station 1 while the subsequent envelope 3 is moved downwards and a new sheet or pack of sheets 2 reaches the filling station 1 (See FIG. 7).

When in normal operation, the number of envelopes 3 present in the envelope filling station 10 may substantially correspond to the number of turns of the screws 21.

The introduction of the sheet 2 through the aperture of the envelope 3 is facilitated by the opening of said aperture by the jets of air supplied by the nozzles 19 (see FIG. 3).

Figure 2:
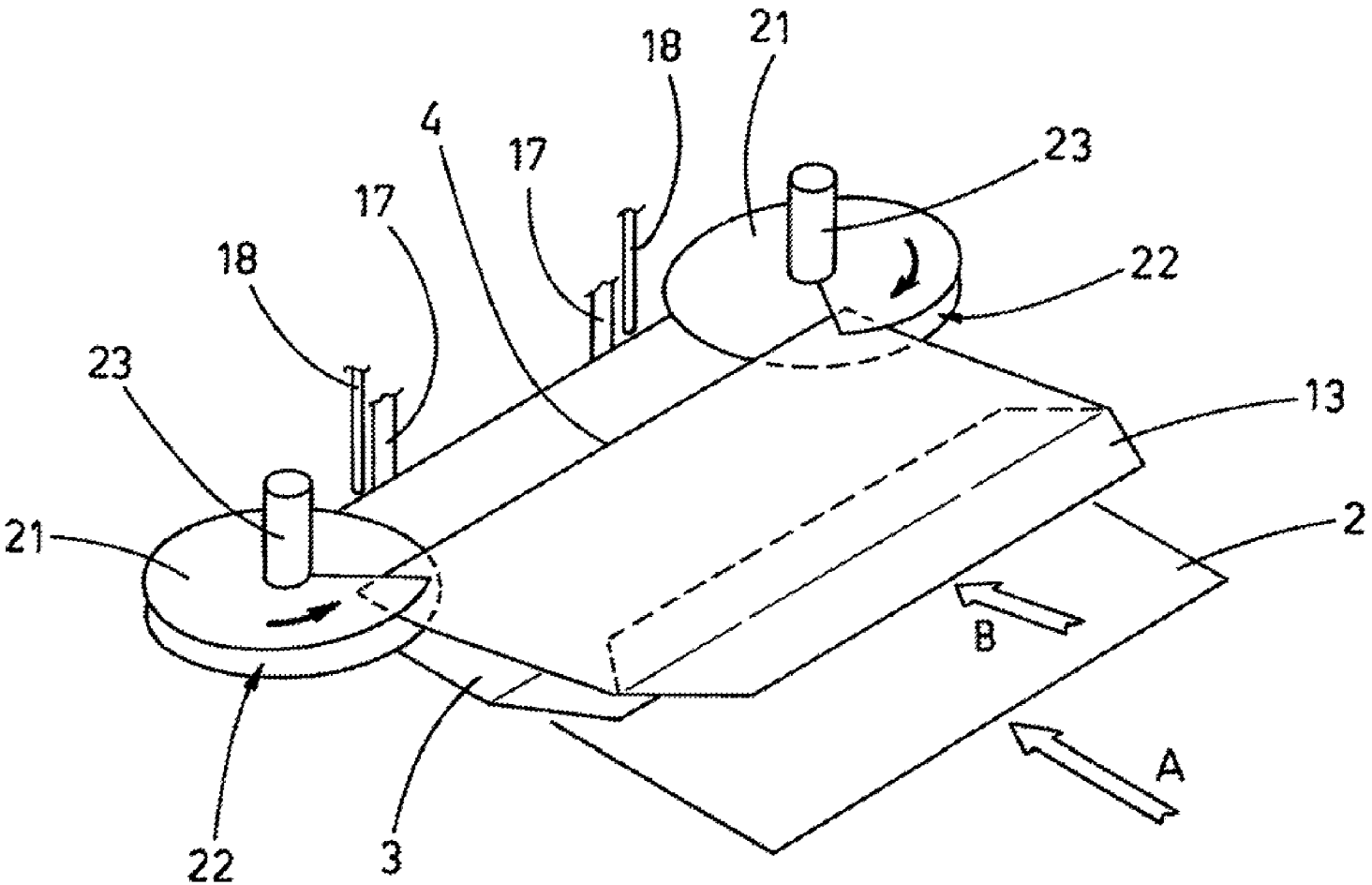
FIG. 2 is a perspective elevation view of the envelope filling station of the machine.

However, the turns of the screws, as it can be seen in FIGS. 1 and 2, are also aimed at preventing' an anomalous swelling of the envelopes 3.

Therefore, the above described envelope filling machine fulfills its object to introduce sheets into envelopes at high operation speed, considerably higher than the speed at which known machines work.

This is obtained in particular due to the substantial elimination of change of direction in the path of the envelopes and of dead times in the envelopes filling, deriving from the use of the handling group 20 equipped with the screws 21, which allow to prepare envelopes to be filled substantially in continuity with the filling and moving away of the previous envelopes.

This obviously allows to reach a very high production rate, with very reduced costs.

It is to be pointed out that this result is obtained by a structure functional and simple, having reduced dimensions, and very reliable. The structure has been even simplified with respect to the one described in the European patent publication 1473173, and a driving conveyor has been eliminated. This eliminates also a transfer action and allows a higher operation speed.

With the filling station of the present invention there is no need of setting a very accurate time relation between exiting of the envelopes from the spaces 22 and contact between the sheets 2 and the envelope bottom, because the movable stop means help to keep yieldingly the envelope during insertion. Also this allows a higher operation speed.

Naturally, all the above described means of the machine are suitably adjustable as a function of the envelopes size.

What is claimed is:

1. An envelope filling machine for introducing sheets into envelopes comprising:

a sliding surface for transferring said sheets in a forward direction to an envelope filling station;

pushing means acting along said sliding surface to move said sheets;

envelope supplying means for supplying each time a single envelope to said envelope filling station, each envelope having a leading edge consisting of a closed, bottom edge of said envelope, a closing flap connected to an opening of said envelope opposite to said closed, bottom edge, and two sides;

the envelope filling station further including:

at least two handling elements for receiving said envelopes one after another and for moving said envelopes downwards while keeping the envelopes separated from one another, said envelopes being introduced between said handling elements;

a conveyor belt situated below said handling elements and extending in an exiting direction opposite to said sliding surface;

stationary stop means for stopping said envelopes when said envelopes are between said handling elements and raised from said conveyor belt;

movable stop means for yieldingly stopping said envelopes when said envelopes are between said handling elements and resting on said conveyor belt, and for allowing a filled envelope to move in said exiting direction under continued action of said pushing means on the sheets already inserted into the envelope, so that said filled envelope leaves the filling station;

said handling means including two screws, rotatable supported on respective vertical shafts and operated to move each envelope of said envelopes from an upper position above said screws, to a lower position resting on said conveyor belt, for the introduction of the sheets into said envelope; and, said vertical shafts being set a distance from one another slightly greater than the width of said envelopes, i.e. the distance between said two sides.

2. A machine as claimed in claim 1, wherein said screws are continuously rotated at a speed suitably controlled as a function of the transferring steps of said envelopes to the envelope filling station and of the introduction of said sheets into the envelopes.

3. A machine as claimed in claim 1, wherein said screws have turns delimiting spaces for receiving said sides of said envelopes due to rotation of the screws.

4. A machine as claimed in claim 1, wherein said screws are arranged at both sides of said conveyor belt and are rotated in opposite directions concurring to keep the envelopes pushed against said stationary and movable stop means.

5. A machine as claimed in claim 1, wherein said envelope supplying means include at least an envelope supplying conveyor situated above said sliding surface, so as to supply envelopes to said envelope filling station in a direction concurrent with said forward direction and said exiting direction.

6. A machine as claimed in claim 1, wherein said stationary stop means include stationary vertical stems situated just after said handling elements, considering said forward direction, and between said handling elements, said stationary vertical stems extending downwards up to a distance from said conveyor belt equal or shorter than the space between two consecutive turns of said screws, sufficient to let an envelope pass under said stationary vertical stems.

7. A machine as claimed in claim 1, wherein said pushing means includes a plurality of lugs, regularly spaced apart along a driving line for acting on a trailing edge of said sheets.

8. A machine as claimed in claim 7, wherein said lugs run within corresponding longitudinal slots made along said sliding surface.

9. A machine as claimed in claim 7, wherein said lugs are kept in a raised position by support means until the sheets are fully inserted into an envelope and said filled envelope leaving said filling station is gripped between said conveyor belt operated in an exiting direction, and at least one pressure roller situated downstream of said envelope filling station in contact with said conveyor belt.

10. A machine as claimed in claim 1, wherein said pressure roller is disposed above and in contact with said conveyor belt to grip and move a filled envelope while leaving said envelope filling station.

11. A machine as claimed in claim 1, wherein said envelope filling station includes one or a pair of nozzles disposed between said sliding surface and said conveyor belt for delivering jets of air to open an envelope situated on said conveyor belt.

12. An envelope filling machine for introducing sheets into envelopes comprising:

a sliding surface for transferring said sheets in a forward direction to an envelope filling station;

pushing means acting along said sliding surface to move said sheets;

envelope supplying means for supplying each time a single envelope to said envelope filling station, each envelope having a leading edge consisting of a closed, bottom edge of said envelope, a closing flap connected to an opening of said envelope opposite to said closed, bottom edge, and two sides;

the envelope filling station further including:

at least two handling elements for receiving said envelopes one after another and for moving said envelopes downwards while keeping the envelopes separated from one another, said envelopes being introduced between said handling elements;

a conveyor belt situated below said handling elements and extending in an exiting direction opposite to said sliding surface;

stationary stop means for stopping said envelopes when said envelopes are between said handling elements and raised from said conveyor belt;

movable stop means for yieldingly stopping said envelopes when said envelopes are between said handling elements and resting on said conveyor belt, and for allowing a filled envelope to move in said exiting direction under continued action of said pushing means on the sheets already inserted into the envelope, so that said filled envelope leaves the filling station;

said movable stop means including two vertical strips supported by oscillating elements, swinging about a horizontal axis extending crosswise to the forward direction, said horizontal axis being situated just after the two stationary vertical stems, said vertical strips being situated bilaterally with respect to the conveyor belt and extending downwards to a level lower than said conveyor belt.

13. An envelope filling machine for introducing sheets into envelopes comprising:

a sliding surface for transferring said sheets in a forward direction to an envelope filling station;

pushing means acting along said sliding surface to move said sheets;

envelope supplying means for supplying each time a single envelope to said envelope filling station, each envelope having a leading edge consisting of a closed, bottom edge of said envelope, a closing flap connected to an opening of said envelope opposite to said closed, bottom edge, and two sides;

the envelope filling station further including:

at least two handling elements for receiving said envelopes one after another and for moving said envelopes downwards while keeping the envelopes separated from one another, said envelopes being introduced between said handling elements;

a conveyor belt situated below said handling elements and extending in an exiting direction opposite to said sliding surface;

stationary stop means for stopping said envelopes when said envelopes are between said handling elements and raised from said conveyor belt;

movable stop means for yieldingly stopping said envelopes when said envelopes are between said handling elements and resting on said conveyor belt, and for allowing a filled envelope to move in said exiting direction under continued action of said pushing means on the sheets already inserted into the envelope, so that said filled envelope leaves the filling station;

said movable stop means including two vertical strips supported by oscillating elements, swinging about a horizontal axis extending crosswise to the forward direction, said horizontal axis being situated just after the two stationary vertical stems;

said oscillating elements including elastic means for keeping said vertical strips down and for yieldingly keeping stopped said envelope during filling with the sheets.

* * * * *